United States Patent [19]

Olsson

[11] Patent Number: 4,637,531

[45] Date of Patent: Jan. 20, 1987

[54] SPOUT WITH GATE

[76] Inventor: Sven O. Olsson, 7019 Kerry Rd., Edina, Minn. 55435

[21] Appl. No.: 707,830

[22] Filed: Mar. 4, 1985

Related U.S. Application Data

[63] Continuation-in-part of Ser. No. 428,121, Sep. 29, 1982, Pat. No. D. 227,827.

[51] Int. Cl.[4] ..... B65D 47/00

[52] U.S. Cl. ..... 222/559; 222/570; 222/327; 251/326

[58] Field of Search ..... 222/326, 327, 325, 544, 222/559, 561, 567, 570, 566; 251/319, 328, 327, 326, 333, 334, 195

[56] References Cited

U.S. PATENT DOCUMENTS

| | | | |
|---|---|---|---|
| D. 92,135 | 5/1934 | Johnson | D9/258 |
| D. 202,452 | 9/1965 | Seaquist | D58/26 |
| D. 206,969 | 2/1967 | Podall | D58/26 |
| D. 210,768 | 4/1968 | Ryan | D9/258 |
| D. 225,733 | 1/1973 | Louise | D9/258 |
| D. 251,953 | 5/1979 | Van Horne | D9/7 |
| 2,253,150 | 8/1941 | Thompson | 222/326 |
| 2,953,285 | 9/1960 | McKelvey | 222/567 |
| 3,272,401 | 9/1966 | Fendler et al. | 222/326 |
| 3,369,714 | 2/1968 | Dewees et al. | 222/327 |
| 3,409,189 | 11/1968 | McKeand, Jr. | 222/561 |
| 3,696,977 | 10/1972 | Davenport et al. | 222/561 |
| 3,982,980 | 9/1976 | van Manen | 156/73.5 |
| 4,015,602 | 4/1977 | Nelsen et al. | 222/561 |
| 4,069,091 | 1/1978 | van Manen | 156/498 |
| 4,258,884 | 3/1981 | Rogers | 222/570 |

FOREIGN PATENT DOCUMENTS

| | | | |
|---|---|---|---|
| 2237468 | 7/1975 | France | 222/326 |
| 883723 | 12/1961 | United Kingdom | 222/567 |

*Primary Examiner*—H. Grant Skaggs
*Assistant Examiner*—Kenneth Noland
*Attorney, Agent, or Firm*—Burd, Bartz & Gutenkauf

[57] ABSTRACT

A spout located on a nozzle of a cartridge containing semi solid material has a movable gate for selectively opening and closing the passage through the spout. The spout has a slot slidably accommodating the gate. An annular bead on the spout surrounds the opening and projects into the slot. The gate has a convex curved portion that engages the bead when the gate is in the closed position to seal the material in the nozzle.

17 Claims, 22 Drawing Figures

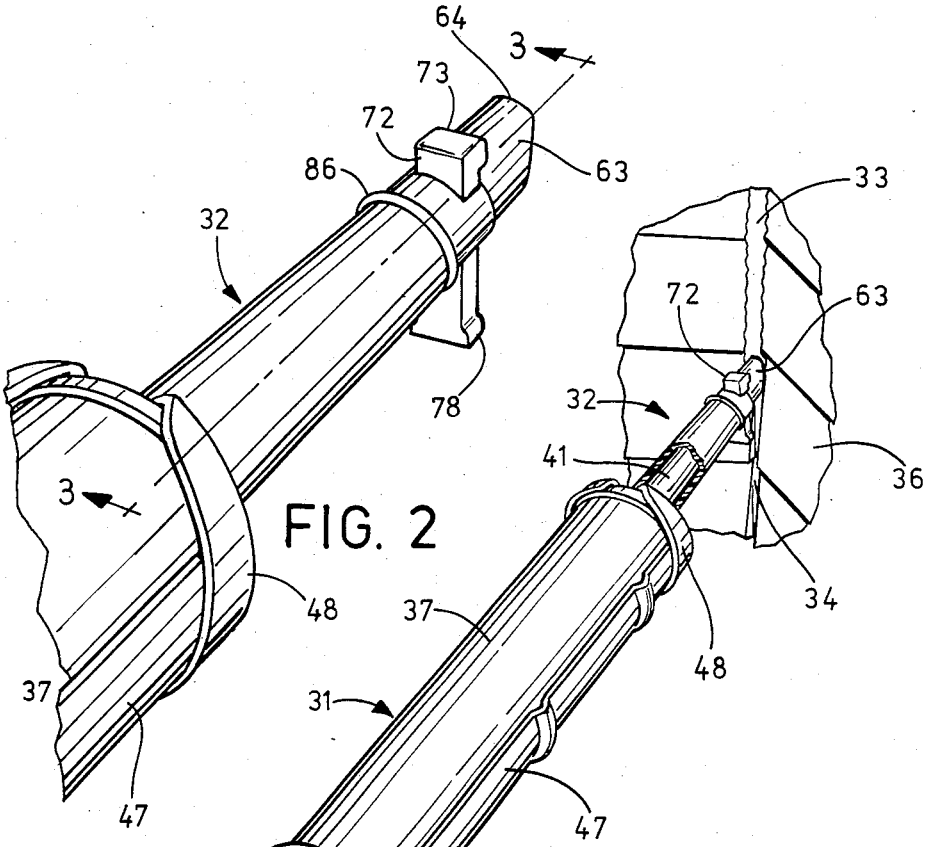
FIG. 2
FIG. 1
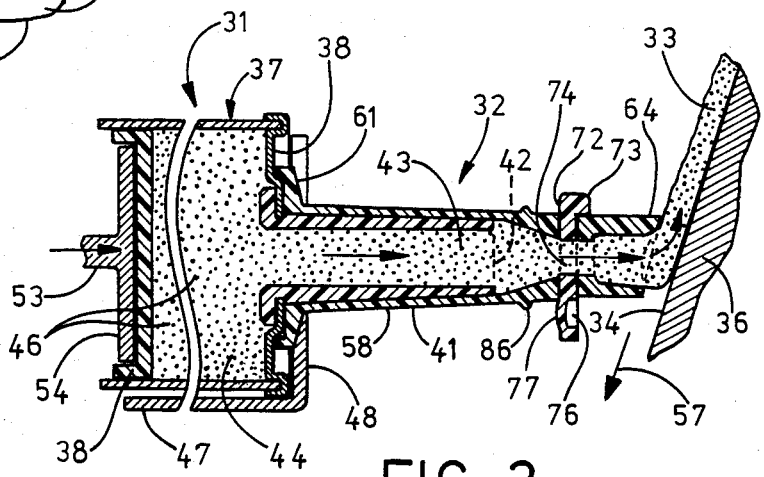
FIG. 3

SPOUT WITH GATE

CROSS REFERENCE TO RELATED APPLICATION

This application is a continuation-in-part of application Ser. No. 428,121, filed Sept. 29, 1982 now U.S. Pat. No. Des. 227,827.

FIELD OF INVENTION

The invention is related to an applicator used to place material in a selected location. The applicator comprises a caulking gun accommodating a material storing cartridge having a nozzle for directing a bead of material along a corner of a structure.

BACKGROUND OF INVENTION

Cartridges having nozzles for storing materials, such as caulking glue, adhesive, sealant, grease and the like, are used with hand operated guns to apply a bead of material along a crack or groove in a structure. The cartridges are elongated cylindrical tubes having an open end accommodating a piston and a closed end having an elongated generally tapered nozzle. A cartridge and a method of making a cartridge is disclosed by Manen in U.S. Pat. No. 4,169,091. The nozzle is normally closed to seal the material within the tube. In use, the end of the nozzle is cut off to provide an opening for the dispensing of the material. Small caps and plugs are used to close the open end of the nozzles. The nozzles do not have any valve structures that are operable to control the flow of material through the nozzles and close the open ends of the nozzles. When the end of a nozzle is exposed to air, the material will dry and harden. This plugs the discharge opening of the nozzle.

SUMMARY OF INVENTION

The invention is directed to a material flow control apparatus for use with a container having a outlet member for directing the material to a selected location. The apparatus is a spout for use with a cartridge having a nozzle for storing material, such as caulking, sealant, grease, and the like. The nozzle is used with a conventional hand operated caulking gun to dispense a continuous bead of material into a desired location such as a crack, crease, or corner of a structure. The spout has body forming a passage of a size to accommodate the nozzle. The body has an outer end section that extends away from the nozzle and terminates in an end having an outlet opening through which the material is dispensed and formed into a continuous bead. A gate means is movably mounted on the outer end section of the body to selectively open and close the passage in the body. The gate means is locatable in a first position that allows the material to flow through the passage and is movable from the first position to a second position to close the passage.

In the preferred form of the spout, the outer end section of the body has a slot extended across the passage. The gate means is slidably located in the slot and movable between the first open position and a second closed position. The gate means has a hole aligned with the passage when the gate means is in the first position. When the gate means has been moved to the second position, it closes the passage. The end section of the body has an annular bead surrounding the passage. The bead projects into the slot and is engageable with the gate means to close the passage. The gate means has a convex curved portion of the gate means is generally aligned with the passage when the gate means is in the second closed position. The annular bead and convex curved portion of the gate means provides a seal between the gate means and the outer end section of the body to protect the material in the nozzle and prevent the material from hardening in the nozzle. The gate means has a tab at one end thereof and ears at the opposite end thereof. The tab and ears are selectively engageable with the body to locate the gate means in the first and second positions.

The body has an inner end that is adapted to be located adjacent the closed end of the cartridge. An outwardly directed flange is joined to the inner end of the body and cooperates with the gun and cartridge to hold the spout in operative assembled relation with the nozzle of the cartridge. A circular lip joined to an outer circular portion of the flange engages the closed end of the cartridge.

The outlet end section of the body has a transverse upper lip that functions to direct and trowel the material as it is discharged from the spout. The lower portion of the lip has a generally transverse recess that allows a continuous and even flow of material past the lip to the desired location. The end of the end section has downwardly tapered sides that include side surfaces that function as guides to minimize the drift and lateral movement of the spout during use. The side surfaces extend outwardly and rearwardly and are adapted to engage adjacent angular portions of a structure that has a crack or groove for accommodating the bead.

The invention includes a cartridge having a nozzle provided with a movable gate for opening and closing the passage in the nozzle. The nozzle has an outer end section provided with a slot that extends across the passage. A gate is slidably positioned in the slot and movable to a first open position and a second closed position. The gate has a hole that is aligned with the passage when it is in the first position. The nozzle is provided with a circular bead surrounding the passage that cooperates with a portion of the gate to seal the passage when the gate is in the second closed position.

The spout and nozzle provided with a gate provides a convenient and reliable closure of the passage for the material that is in the cartridge. The gate is manually moved to an open position allowing the cartridge and the gun to be utilized to apply a bead of material to a desired location. When the job is completed, the gate can be moved to the closed position to seal the material within the cartridge. The spout with the gate is useable with a conventional cartridge having nozzles. The nozzle with the gate can be used with a cartridge adapted to fit into a conventional caulking gun. The nozzle and cartridge can be a unitary plastic structure. These and other objects and advantages of the spout and nozzle with a gate are embodied in the spout and nozzle structures set forth in the following detailed description.

DESCRIPTION OF DRAWINGS

FIG. 1 is a perspective view of a caulking gun holding a cartridge of material in assembled relation with the spout of the invention;

FIG. 2 is an enlarged perspective view of the spout and forward end of the gun and cartridge of FIG. 1;

FIG. 3 is a sectional view taken along the line 3—3 of FIG. 2;

DESCRIPTION OF PREFERRED EMBODIMENTS

Figure 4:
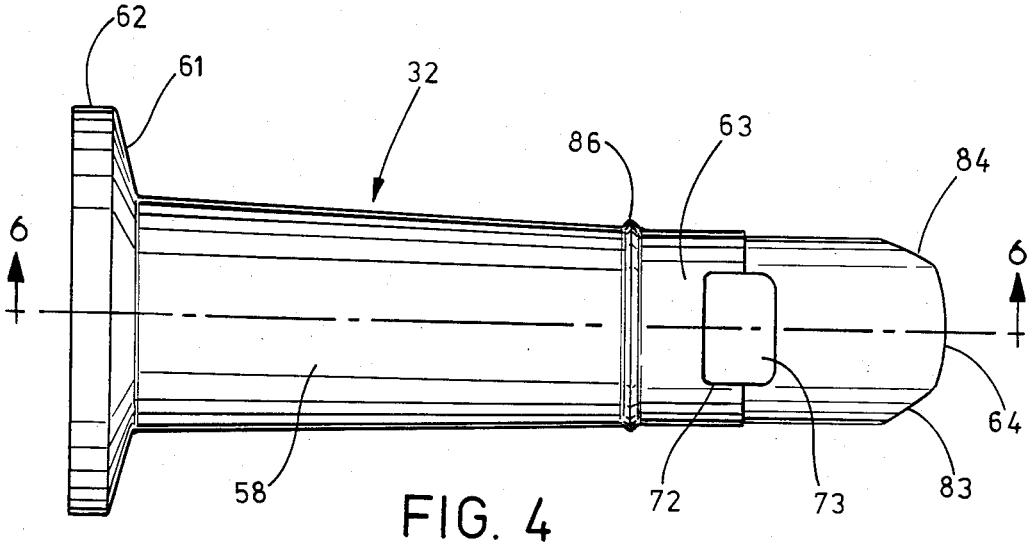
FIG. 4 is an enlarged top view of the spout.
Figure 5:
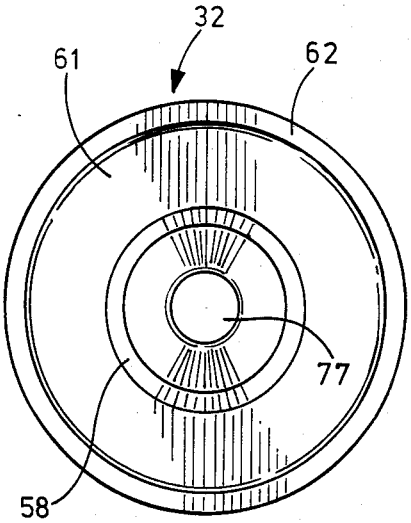
FIG. 5 is an end view of the left or inlet end of FIG. 4.

Referring to FIGS. 1 to 3, there is shown hand operated material dispenser gun, known as a caulking gun, indicated generally at 30 holding a cartridge 31 accommodating material, such as caulking compounds, adhesives, sealants, and the like. A spout, indicated generally at 32, on the outlet end of cartridge 31 controls the thickness and uniformity of a bead 33 of material during the application of the bead into a corner 34 of a structure 36. Cartridge 31 has a tube or cylindrical member 37 made of paper, metal, or the like, for storing material 46. Tube 37 has an open end accommodating a piston 38. The opposite end of the tube 37 has an end wall or plug 39 clamped unto the cylindrical side wall of tube 37. A nozzle 41 comprising an elongated tubular member is mounted on the central portion of end wall 39. Nozzle 41 is normally closed to retain material in tube 37. Nozzle 41 is cut at 42 open passage 43 for carrying material 46 in the cartridge chamber 44 through the open end of nozzle 41. Cartridge 31 is a conventional tubular structure used to store flowable material, as plastic, adhesives, sealants and the like. An example of a cartridge and method of making the cartridge is disclosed in U.S. Pat. No. 4,069,091.

Dispensing gun 30 has an elongated U-shaped body 47 supporting an upwardly open yoke 48. Yoke 48 has a slot accommodating inlet end of nozzle 41. The opposite end of body 47 has a generally cup-shaped end member 49. A handle 51 is attached to end member 49. A lever 52 pivotally mounted on handle 51 operatively engages a rod 53 to move piston 54 into tube 37 thereby forcing the material 46 through the nozzle passage 43 and spout 32 to form continuous bead 33. Gun 30 is operated with the operator's hand 56. Hand 56 is also used to move gun 30 in a downward direction generally parallel to corner 34, as shown by the arrow 57 in FIG. 3, to form the uniform continuous bead 33. The gun can be an air pressure operated caulking gun.

Figure 6:
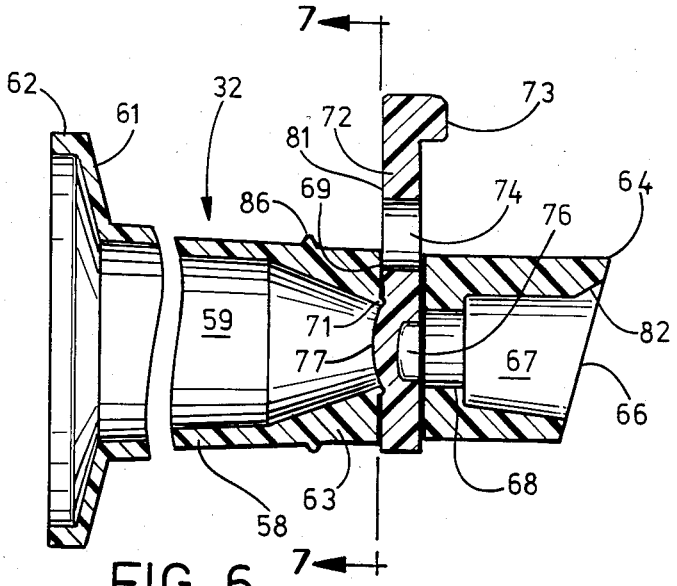
FIG. 6 is a foreshortened sectional view of the spout taken along the line 6—6 of FIG. 4 showing the gate in the closed position.

As shown in FIG. 3 and 6, spout 32 is an elongated tubular body 58 having a passage 59 adapted to accommodate nozzle 41. Passage 59 tapers inwardly from the inner end thereof so that it telescopes onto nozzle 41. The inner end of body 58 is integral with an outwardly directed annular flange 61. Flange 61 terminates in a short inwardly directed circular lip 62.

Figure 7:
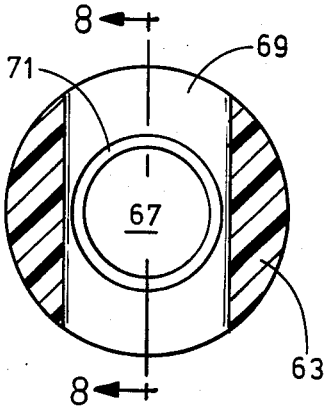
FIG. 7 is an enlarged sectional view taken along the line 7—7 of FIG. 6.
Figure 8:
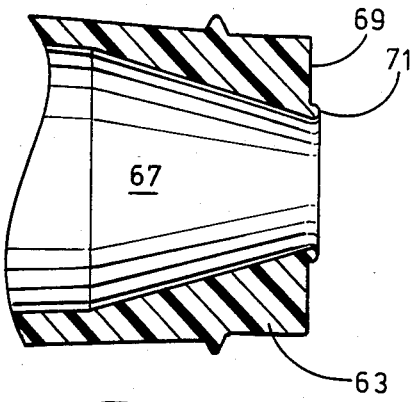
FIG. 8 is a sectional view taken along the line 8—8 of FIG. 7.
Figure 14:
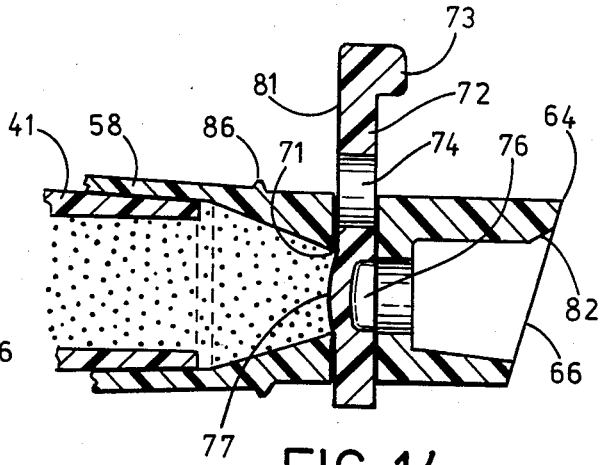
FIG. 14 is a sectional view similar to FIG. 9 showing the gate in the closed position.

The forward end of body 58 has an outer end section or nose 63 terminating in a top generally convex curved lip 64. The end 66 of section 63 extends downwardly and rearwardly from lip 64. Section 63 has a passage 67 in communication with passage 59. The mid-portion of section 63 has an inwardly directed annular inside wall or rib 68 surrounding passage 67. Wall 68 reduces the size of passage 67. The mid-section of end section 63 has a rectangular hole 69 that extends through passage 67. As shown in FIGS. 7 and 8, the inside wall 63 has a forwardly directed circular bead or continuous rib 71 that surrounds passage 67. Bead 71 functions as a annular seal with a sliding gate 72. As shown in FIGS. 6, 7, and 14, gate 72 is slidably positioned through rectangular slot or hole 69. The upper end of gate 72 has a grip or tab 73 to facilitate the manual movement of gate 72 to open and closed positions relative to body 58 and passage 67.

Figure 9:
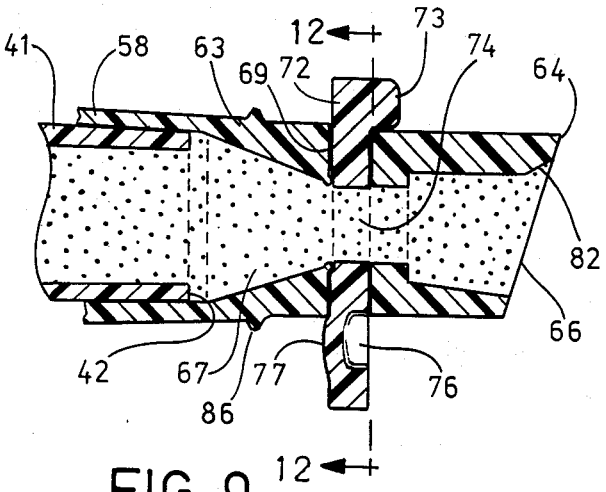
FIG. 9 is a sectional view similar to FIG. 6 showing spout on a nozzle with the gate in the open position.

Gate 72 has a hole 74 located in alignment with passage 67 when tab 73 has been moved down into engagement with end section 63 as shown in FIG. 9. This allows material 46 to be moved through end section 63 by the operation of gun 30. Gate 72 has a recess 76 in the lower portion thereof. Recess 76 is closed with a convex bottom wall 77. Gate 72 has a flat side surface 81 that engages the circular bead 71. The convex wall 77 is aligned with passage 76 when the gate is moved to the up or closed position as shown in FIG. 6. Wall 77 holds the flat side 81 in tight sealing engagement with circular bead 71.

Figure 10:
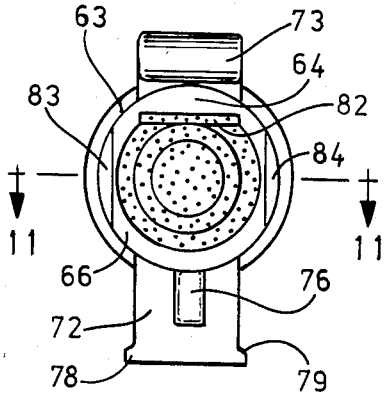
FIG. 10 is an end view of the discharge end of FIG. 9.
Figure 12:
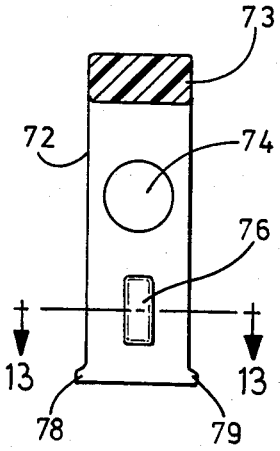
FIG. 12 is an enlarged sectional view of the gate taken along the line 12—12 of FIG. 9.
Figure 13:
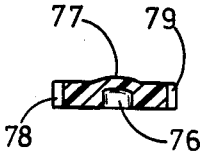
FIG. 13 is a sectional view taken along the line 13—13 of FIG. 12.

As shown in FIGS. 10, 12, and 13, a pair of outwardly directed ears 78 and 79 are located on the bottom of gate 72. Ears 78 and 79 engage the bottom of section 63 when gate 72 is in the up or closed position. Ears 78 and 79 also minimize the inadvertant removal of gate 72 from end section 63. Gate 72 is a flexible generally flat member made of plastic and like materials.

Figure 11:
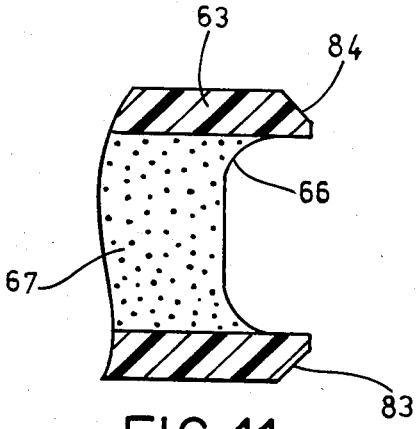
FIG. 11 is an enlarged sectional view taken along the line 11—11 of FIG. 10.

Lip 64 has a lower inclined wall 82 that provides a transverse recess adjacent the top part of the outlet opening 67 for the material. This recess facilitates the flow of the material past lip 64. The outer end section 63 has side surfaces 83 and 84, shown in FIGS. 4, 10, and 11, that guide the spout 32 as it is moved along the corner receiving bead 33. The side surface 83 and 84 are normally disposed relative to each other and extend in a forwardly converging direction. Surfaces 83 and 84 can have other angles relative to the longitudinal center line of spout 32.

Body 58 has an outwardly directed annular rib 86. The rib 86 serves as a length guide for cutting the end of nozzle 41 on a cartridge 31.

In use, the end of nozzle 41 is initially cut open to provide an open end allowing the material to be forced from the cartridge by gun 30. The tubular body 58 is placed over nozzle 41 with gate 72 in its raised or closed position. Cartridge 31, along with spout 32, is then placed in the body 47 of gun 30. Flange 61 is located adjacent the inside of yoke 48, as shown in FIG. 3. This holds spout 32 in tight relation relative to nozzle 41. Gate 72 is moved to the down position opening passage 67. The material can then be forced from cartridge 31 through spout 32. The side guide surfaces 83 and 84 move along the adjacent surfaces of structure 36 as shown in FIG. 1. The material flows under lip 64 and forms the continuous elongated and uniform bead 33. When the job is completed gate 72 is moved to its second closed position to close and seal off passage 67. The spout and cartridge can be reused. The gate 72 is flexed to remove material from hole 74 before it is moved down to the open position. The hard material, if any, in the outer end of passage 67 is readily removed. The spout 32 is ready to apply a bead to a desired location.

Figure 15:
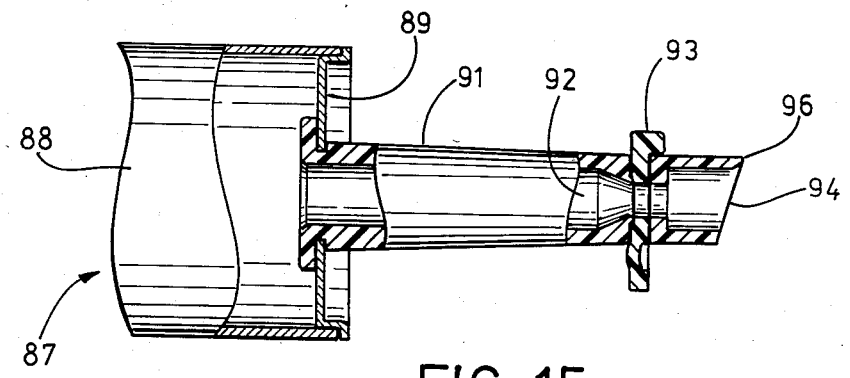
FIG. 15 is a first modification of a cartridge having a nozzle equipped with a gate.

Referring to FIG. 15, there is shown a first modification of a nozzle assembly mounted on a cartridge 87. Cartridge 87 has an elongated tubular body 88 for accommodating the material to be dispensed. The one end of the body is closed with a pan shaped end member 89 supporting an elongated tubular nozzle 91. Nozzle 91 has a passage 92 open to the interior of cartridge 87 and an outlet end 94. A gate 93 is interposed in the nozzle 91 adjacent the outlet end 94. Gate 93 and outlet end 94 have the gate and associated spout structure shown in FIGS. 6 to 11. The top portion of the outlet end 94 has a lip 96 that corresponds to lip 64 of spout 32. The outlet end of nozzle 91 has side guide surfaces to aid in controlling the movement of the nozzle during disposing of material therefrom.

Figure 16:
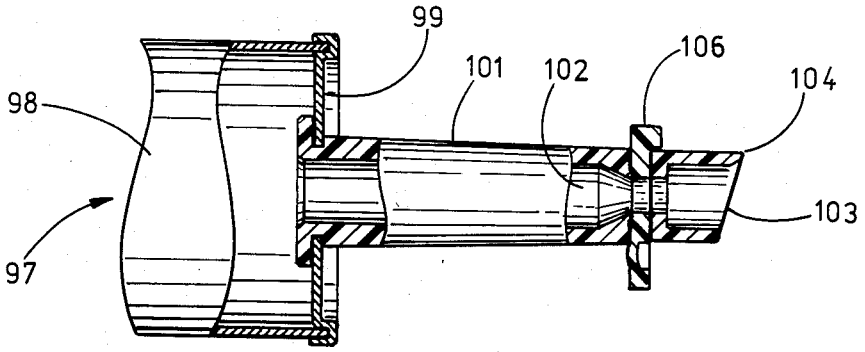
FIG. 16 is a second modification of a cartridge having a nozzle equipped with a gate.

Referring to FIG. 16, there is shown a second modification of a cartridge 97 having a tubular body 98. One end of the body 98 is closed with a end 99 crimped about tubular body 98. An elongated nozzle 101 is mounted on end member 99. Nozzle 101 has a passage 102 open to the chamber of cartridge 97 and an open outer end 103. The top of open end 103 has a lip 104 that conforms to the shape of lip 64. A manually movable gate 106 is located in the outer end portion of nozzle 101. Gate 106 and the end structure of nozzle 101 corresponds to the gate and spout structure as shown in FIGS. 6 to 14.

Figure 17:
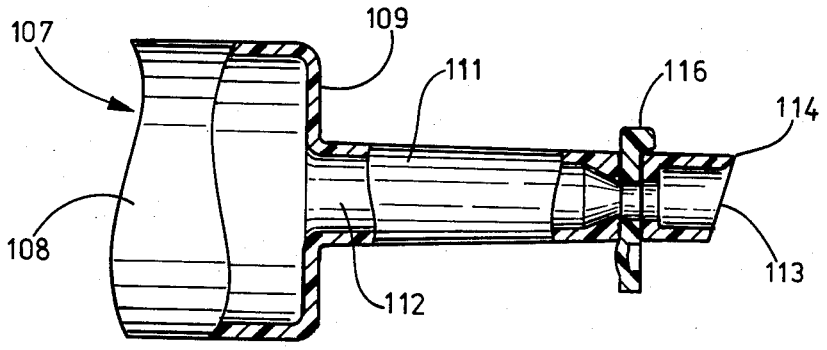
FIG. 17 is a third modification of a cartridge having a nozzle equipped with a gate.
Figure 18:
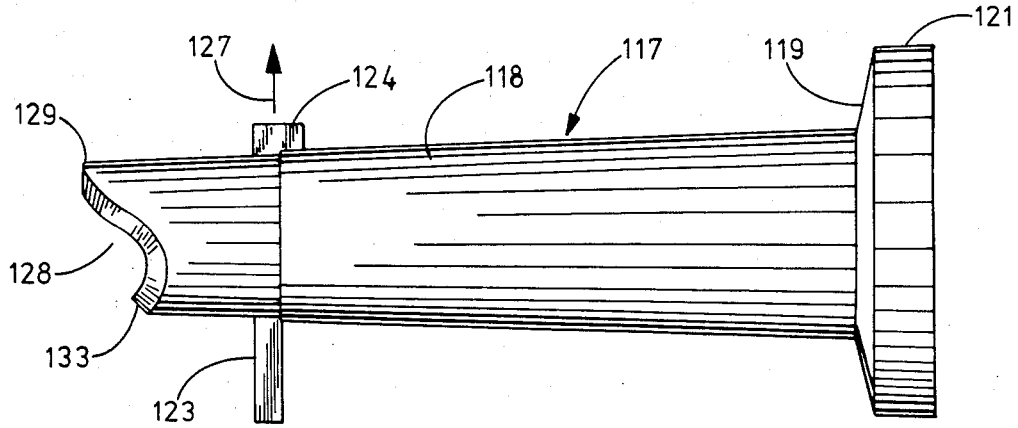
FIG. 18 is a side view of a modification of the spout.
Figure 19:
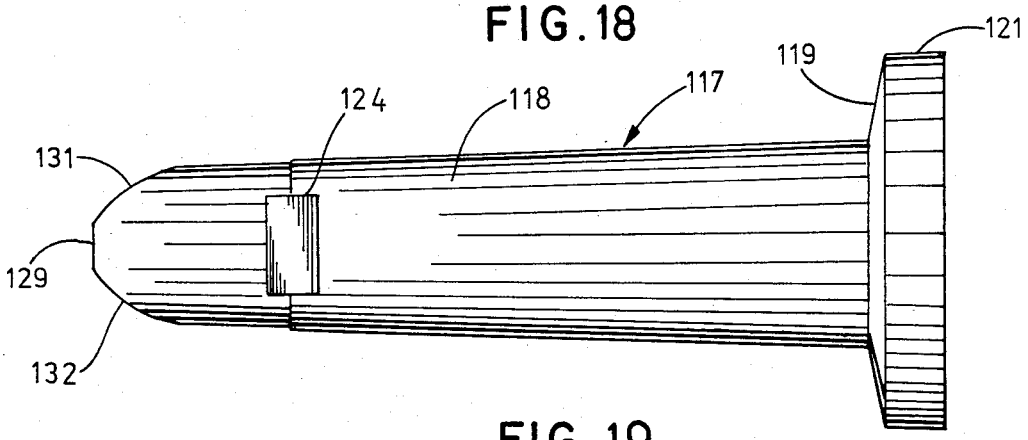
FIG. 19 is a top view of FIG. 18.
Figure 20:
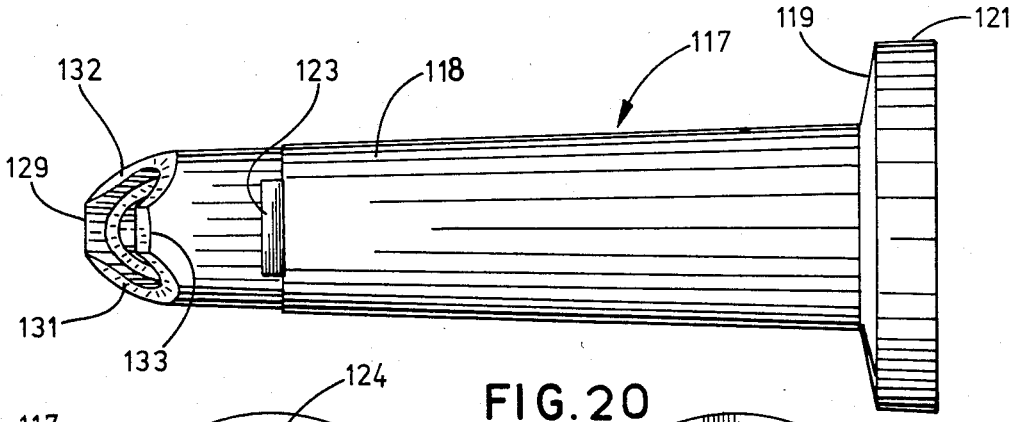
FIG. 20 is a bottom view of FIG. 19.

Referring to FIG. 17, there is shown a third modification of a cartridge 107 having a tubular body 108. An end 109 and nozzle 111 are integral with an end of tubular body 108. The body 108, end 109, and nozzle 111 are an integral one-piece plastic structure. Nozzle 111 has a passage 112 open to the chamber of cartridge 107 and an open end 113. End 113 is a top lip 114 that conforms to the shape of lip 64. The outer end portion of nozzle 111 has a manually movable gate 116. Gate 116 and the nozzle structure adjacent gate 116 correspond to the gate 72 and adjacent spout structure shown in FIGS. 6 to 14.

Figure 21:
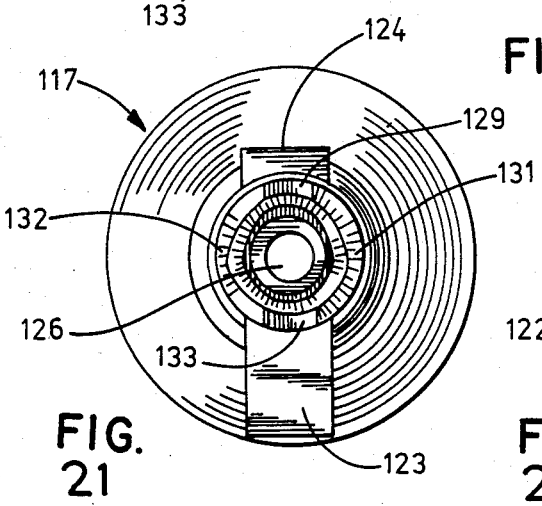
FIG. 21 is an end view of the left end of FIG. 18.
Figure 22:
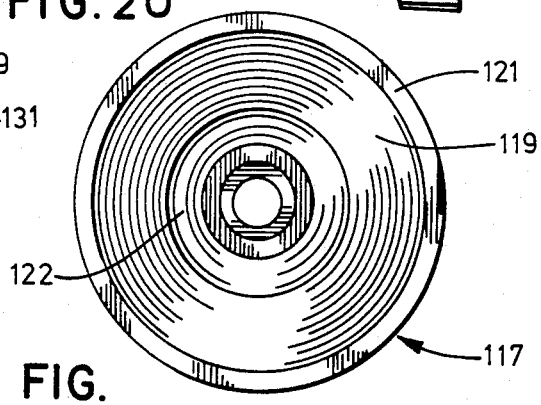
FIG. 22 is an end view of the right end of FIG. 18.

Referring to FIGS. 18 to 22, there is shown a further modification of the spout of the invention indicated generally at 117. Spout 117 is adapted to fit over a nozzle of a cartridge in a manner as shown in FIGS. 1 to 3. Spout 117 has an elongated tapered tubular body 118 joined at one end to an outwardly directed flange 119. The outer edge of flange 119 has a circular lip 121. Tubular body 118 has an elongated tapered passage 122 as seen in FIG. 22. The material flow through passage 122 is controlled by a manually movable gate 123. Gate 123 has a generally flat member having a tab 124 at the upper end thereof. A mid-portion of gate 123 has a hole 126 to allow the material to flow through spout 117. Hole 126 is aligned with passage 122 in the tubular body when tab 124 engages tubular body 118 as shown in FIG. 21. Gate 123 is moved in an upward direction as shown by arrow 127 in FIG. 18 to close passage 122.

Spout 117 has an open outlet end 128 having a top lip 129 and downwardly and inwardly inclined side guide surfaces 131 and 132. Surfaces 131 and 132 serve as guides for minimizing the side drift or movement of the spout during the application of the bead to its location such as a crack in a structure. The side surfaces 131 and 132 are joined to a short lower lip 133. Lip 133 serves as a rudder to steer the end of the spout along the groove or crack to be filled with the bead.

While there has been shown and described prefered embodiments of the spout with the gate of the invention, it is understood that changes in the structure of the nozzles, spouts, and gates can be made by those skilled in the art without departing from the invention. The invention is defined in the following claims.

The embodiments of the invention in which an exclusive property or privilege is claimed are defined as follows:

1. A spout for use with a cartridge having a nozzle for storing material and a gun for forcing material within said cartridge through said nozzle comprising:

a body having a passage of a size to accommodate said nozzle and an outer end section adapted to extend from said nozzle, said outer end section having a slot extended through said end section and across said passage and a continuous annular bead surrounding said passage, said annular bead projected into the slot, and gate means extended through said slot slidably movable between a first position to allow material to flow through said passage and a second position to block flow of material through said passage, said gate means having a hole aligned with the passage when the gate means is in said first position to allow material to flow through said passage, said gate means having a convex curved portion spaced from the hole, and a recess opposite said convex curved portion, said convex curved portion projected toward said annular bead and surrounded by said annular bead to close the passage when the gate means is in said second position.

2. The spout of claim 1 wherein: said gate means has a tab at one end thereof and ear means at the opposite end thereof, said tab and ear means being selectively engageable with said body to locate the gate means in said first and second positions.

3. The spout of claim 1 including: an outwardly directed circular flange joined to the end of the body opposite the outlet end section.

4. The spout of claim 3 including: a circular tip joined to an outer circular portion of said flange.

5. A spout for use with a cartridge having a nozzle for storing material in a gun for forcing material within said cartridge through said nozzle comprising: a body having a passage of a size to accommodate said nozzle in an outer end section adapted to extend from said nozzle, said outlet end section having a generally transverse upper lip and outwardly and rearwardly directed side sections, said outer end section further having a slot extended through said end section and across said passage and a continuous annular bead surrounding said passage, said annular bead projected into the slot, gate means extended through said slot slidably movable between a first position to allow material to flow through said passage and a second position to block the flow of material through said passage, said gate means having a hole aligned with the passage when the gate means is in the first position to allow material to flow through said passage, said gate means having a convex curved portion spaced from the hole, said convex curved portion projected toward said annular bead and surrounded by said annular bead to close the passage when the gate means is in the second position.

6. The spout of claim 5 wherein: said lip has a generally transverse recess on the lower side thereof.

7. The spout of claim 5 wherein: said gate means has a tab at one end thereof engageable with the body to locate the gatemeans in said first position.

8. A spout for dispensing material comprising: a body having a passage, an inlet end, and an outlet end section, said outlet end section having a generally transverse upper lip, a transverse slot extended across said passage and a continuous annular bead surrounding the passage, said bead projected into the slot, and gate means having a hole allowing material to flow through said passage and a convex curved portion spaced from the hole, and a recess opposite said convex curved portion, said convex curved portion projected toward said annular bead, said gate means being movable to a first position wherein the hole is aligned with said passage to allow flow of material through said passage and movable from the first position to a second position wherein the convex curved portion is surrounded by said annular bead to close said passage.

9. The spout of claim 8 wherein: said outer end section has side portions extended outwardly and rearwardly for guiding the outlet end section of the spout along angularly disposed surfaces.

10. The spout of claim 8 wherein: said gate means has a tab at one end thereof and ear means at the opposite end thereof, said tab and ear means being selectively engageable with said body to locate the gate means in said first and second positions.

11. The spout of claim 8 wherein: said gate means has a tab at one end thereof engageable with the body to locate the gate means in said first position.

12. The spout of claim 8 including: an outwardly directed flange joined to the inlet end of the body.

13. The spout of claim 12 including: a circular lip joined to an outer circular portion of said flange.

14. A spout for dispensing material comprising: a body having a passage, an inlet end, and an outlet end section, said outlet end section having a generally transverse upper lip, said lip having a generally transverse recess on the lower side thereof, a transverse slot extended across said passage, and a continuous annular bead surrounding the passage, said bead projected into the slot, and gate means having a hole allowing material to flow through said passage and a convex curved portion spaced from the hole, said convex curved portion projected toward said annular bead, said gate means being movable to a first position wherein the hole is aligned with said passage to allow flow of material through said passage and movable from the firt position to a second position wherein the convex curved portion is surrounded by said annular bead to close said passage.

15. The spout of claim 14 wherein: said outer end section has side portions extended outwardly and rearwardly for guiding the outlet end section of the spout along angularly disposed surfaces.

16. A nozzle adapted to be joined to a cartridge for accommodating material comprising:

an elongated tubular member having a continuous passage, a slot intersecting said passage and a continuous annular bead surrounding the passage, said bead projected into the slot, gate means slidably located in said slot, said gate means having a hole to allow material to flow through the passage and a convex curved portion spaced from the hole, and a recess opposite said convex curved portion, said convex curved portion projected toward said annular bead, said gate means movable to a first position relative to the tubular member to align the hole with the passage to allow flow of material through said passage and movable from the first position to a second position wherein the convex curved portion is surrounded by said annular bead to close said passage.

17. The nozzle of claim 16 wherein: said gate means has a tab at one end thereof engageable with said nozzle to locate the gate means in said first position.

* * * * *